United States Patent [19]

Scott et al.

[11] Patent Number: 4,596,516

[45] Date of Patent: Jun. 24, 1986

[54] GAS LIFT APPARATUS HAVING CONDITION RESPONSIVE GAS INLET VALVE

[75] Inventors: George M. Scott; R. Lyall Tegart, both of Calgary, Canada

[73] Assignee: Econolift System, Ltd., Alberta, Canada

[21] Appl. No.: 631,156

[22] Filed: Jul. 16, 1984

[30] Foreign Application Priority Data

Jul. 14, 1983 [CA] Canada ..... 432476

[51] Int. Cl.[4] ..... F04B 47/12; E21B 43/00

[52] U.S. Cl. ..... 417/58; 166/53; 166/369; 166/372; 166/265

[58] Field of Search ..... 417/54–60, 417/109, 116; 166/53, 65 R, 72, 73, 106, 265, 369, 372

[56] References Cited

U.S. PATENT DOCUMENTS

| | | | |
|---|---|---|---|
| 1,803,683 | 5/1931 | Taylor | 417/54 |
| 1,833,778 | 11/1931 | Fletcher | 417/60 |
| 2,341,359 | 2/1944 | Buckley | 166/265 X |
| 2,714,855 | 8/1955 | Brown | 417/57 |
| 2,838,006 | 6/1958 | Garrett et al. | 417/59 |
| 3,090,316 | 5/1963 | Montgomery | 417/58 X |
| 3,410,217 | 11/1968 | Kelley et al. | 417/58 |
| 3,427,989 | 2/1969 | Bostock et al. | 417/116 X |
| 3,897,822 | 8/1975 | Mott | 166/72 |
| 3,941,511 | 3/1976 | Morgan | 417/57 |
| 4,251,191 | 2/1981 | Gass et al. | 417/54 |
| 4,417,858 | 11/1983 | Stout | 417/58 |

FOREIGN PATENT DOCUMENTS

| | | | |
|---|---|---|---|
| 848766 | 8/1970 | Canada | 417/58 |
| 890226 | 1/1972 | Canada | 417/58 |
| 1133825 | 10/1982 | Canada | 417/57 |

*Primary Examiner*—William L. Freeh
*Assistant Examiner*—Paul F. Neils
*Attorney, Agent, or Firm*—Cushman, Darby & Cushman

[57] ABSTRACT

A novel gas lift apparatus is described which is particularly useful for the dewatering of gas wells in which the gas pressure is low or for the lifting of oil from wells when mixed oil and gas are produced. Water or oil is allowed to collect in the tubing above the valve of the apparatus. Sensors provide indications of the water level or the hydrostatic head within the tubing, and of the gas pressure in the casing. The outputs of the sensors are fed to an electronic, pneumatic or hydraulic controller which at a predetermined differential pressure opens the valve. Alternatively, a timer can be used to energize the valve at a predetermined time.

12 Claims, 4 Drawing Figures

GAS LIFT APPARATUS HAVING CONDITION RESPONSIVE GAS INLET VALVE

This invention relates to a novel gas lift apparatus for lifting fluid from a well or similar bore. It is of particular use in the dewatering of gas-producing wells, but it can also be used for lifting oil in oil wells particularly where the oil is produced naturally with gas. It is characterized by the use of a valve which is controlled from the surface to admit gas to the tubing string.

In a gas well in which the formation pressure is high, the velocity of flow is also high so that droplets of water which are normally associated with the gas are carried upward therewith and hence come out with the gas. If there is a relatively large amount of water, even wells with a high flow rate may not carry out all of the water, so that the water will collect at the bottom of the well and may in time impede or cut off production. The problem becomes more acute when the formation pressure is low. In such a case, water, and in some cases oil, entrained in the gas falls out and accumulates in the bottom of the well. If these liquids are not removed back pressure will build up so as to decrease or even to prevent gas flow.

In a gas well, the casing is perforated at one or more levels where the well passes through a gas-bearing formation to permit the ingress of gas from the surrounding formation. When a gas well becomes partially depleted, with consequent reduction of the velocity of the gas, there is an increasing tendency for liquid, chiefly water, to build up in the bottom of the well. When the liquid rises above the level of the perforations through which the gas flows, a back pressure is created reducing or even preventing gas flow. In areas where formation gas pressure is low or wells are nearing the point of depletion it is particularly important to have an efficient system for the removal of water from the well and one which causes a minimum of interference with production.

It is already known to remove liquids from a well by gas lift. To this end a tubing string is located in the well extending downward into the accumulated liquid and having an opening to admit liquid into the string. In the case of oil wells gas may be forced into the tubing at chosen intervals along the string to cause the liquid within the tubing to rise to the surface. A freely movable plunger or pig is usually located in the tubing in order to reduce the penetration of gas through the liquid, and this plunger rises to the surface together with each slug of liquid.

Canadian Pat. No. 1,133,825, entitled "Surface Controlled Liquid Removal System for Gas Producing Wells", issued to Bolling A. Abercrombie, Oct. 19, 1982 describes a system for removing accumulated liquids from gas-producing wells which is said to avoid back pressure on the formation as the liquid builds up in the well. In that patent a tailpipe is located in the lower part of the casing with its lower end in communication with the accumulated liquid. A string of the tubing extends downwardly from the surface within the casing, and both the tubing and the casing communicate with the sales line. Liquid passes from the tailpipe to the casing, then to the tubing. Periodically, the tubing and the casing are closed to the sales line and formation pressure then builds up in the casing causing the liquid in the tubing to rise. At that point the tubing is opened to the sales line. Casing pressure will then force the liquid upwards into the sales line after which the casing is opened to the sales line, and the cycle of liquid build up and dewatering is repeated. The cycle is controlled by surface valves. This system is not suitable for use in gas wells where the formation pressure is low, since it requires considerable down-time for the gas pressure in the casing to build up to the point where it is sufficient to force out the liquid.

Gas lift systems for oil and gas wells are also known employing hydraulic valves located down the well. When the gas pressure in the casing is sufficient a valve opens to admit gas into the tubing string to force liquid in the string to the surface. Examples of such systems are found in Canadian Pat. No. 848,766, issued Aug. 11, 1970, and in Canadian Pat. No. 890,226, issued Jan. 11, 1972, both in the names of Kork Kelley and Robert K. Kelley. However, such systems require relatively high differential gas pressures to operate reliably.

It has been found in practice that the down-hole hydraulic valves employed in gas lift systems do not open and close properly if the pressure differential is low. Thus while such valves may operate satisfactorily when the gas pressure is high they are not suitable for use in low-pressure gas wells.

The system of the present invention provides a simple, economical and reliable means for removal of liquid from producing wells, particularly for the dewatering of gas wells or the removal of oil from wells where mixed oil and gas are present. It is especially advantageous for the removal of liquid from gas wells in which the gas production is insufficient to entrain all of the water coming out of the formation and lift it to surface during normal production.

With the present system, there is a conventional tubing string which extends downwardly from the surface within the casing. The tubing terminates at its lower end in a crossover assembly, which blocks it. A tailpipe extends downwardly from the crossover assembly. A packer seals the annular passage between the tailpipe and the casing. Separated liquid collects in the space above the packer and in the lower portion of the tubing string, which is connected to the collection space between the casing and the tubing string by a transverse channel.

A valve operated from the surface is housed in a suitable mandrel (a tubing length modified to hold the valve) integral with the tubing string. The valve may be opened and closed by a small electric motor; alternatively, a solenoid operated valve, or a hydraulic or pneumatic valve can be used. In one embodiment of the invention, an electronic controller monitors the hydrostatic pressure of collected water at a desired point in the tubing string and compares this pressure with the gas pressure in the annular passage between the casing and the tubing string. When a pre-set differential pressure is reached a controller causes the valve to open admitting gas from the casing into the tubing string to raise the water to the surface.

In an alternate embodiment, the operation of the valve is controlled by a timer, which may if desired be reset from the surface of the well.

In a further alternate embodiment, the valve is opened when the water level in the well reaches a predetermined level, and is closed when a plunger rises to the top of the tubing string pushing a slug of water or oil and activating a switch to effect valve closure.

The low friction plunger (called a "pig" in oil field terminology) is located in the tubing string above the mandrel to reduce the penetration of the liquid by the gas which is elevating it. The plunger rises to the surface with each slug of liquid. When the water or other liquid being removed has been dumped and the valve has been closed, the plunger falls by gravity to its normal location above the mandrel.

In accordance with a broad aspect of the invention there is provided apparatus for removing accumulated liquid from a gas or oil well and located within the well in a region where liquid accumulates, said apparatus comprising a length of tubing adapted to form a portion of a tubing string and to pass liquid therethrough;

a channel connecting said length of tubing to the well casing;

a normally closed valve blocking said channel, said valve opening upon actuation to admit gas from within said well casing into said section of tubing; and an actuating means to operate said valve, said actuating means being operable from the surface of the well.

In the preferred embodiment the apparatus also includes an electronic controller which energizes said actuating means at a predetermined differential between the hydrostatic pressure in the tubing string at a predetermined level (conveniently the level of the apparatus) and the gas pressure in the well casing.

There is also provided, in accordance with the invention, gas well apparatus including apparatus for removing accumulated liquid therefrom and comprising:

a casing extending downward from the ground surface into a gas-bearing stratum, said casing having openings therein to admit gas from said stratum into said casing;

a tubing string situated within said casing, said tubing string being vented to atmosphere at its upper end and said tubing string terminating at its downward end in a first sealing means;

a tailpipe extending downwardly from said first sealing means as a downward extension of the tubing string and being closed at its upper end by said first sealing means;

an annular passage defined by the interior of the casing and by the respective exteriors of the tubing string and tailpipe;

second sealing means to prevent flow through the annular passage above the openings to admit gas into the casing;

a port to permit flow between the tubing and the annular passage above said first sealing means, but in a region where liquid is expected to collect in the annular passage;

a pipe for the passage of gas and entrained liquid extending from the upper portion of the tailpipe to said annular passage above said second sealing means;

a valve operable upon actuation to admit gas from the annulus to said tubing below the surface of liquid in said tubing thereby to lift a slug of liquid to the ground surface, and means to actuate said valve from ground surface.

Preferably, the actuating means actuate the valve at a predetermined differential pressure between the hydrostatic pressure of liquid at a selected point in the tubing string and the gas pressure in the annular passage, although actuation by a timing cycle or by sensing water level (which is directly related to differential pressure) is also possible.

Embodiments of the invention will now be described which are to be read in conjunction with the accompanying drawings, wherein.

Figure 1:
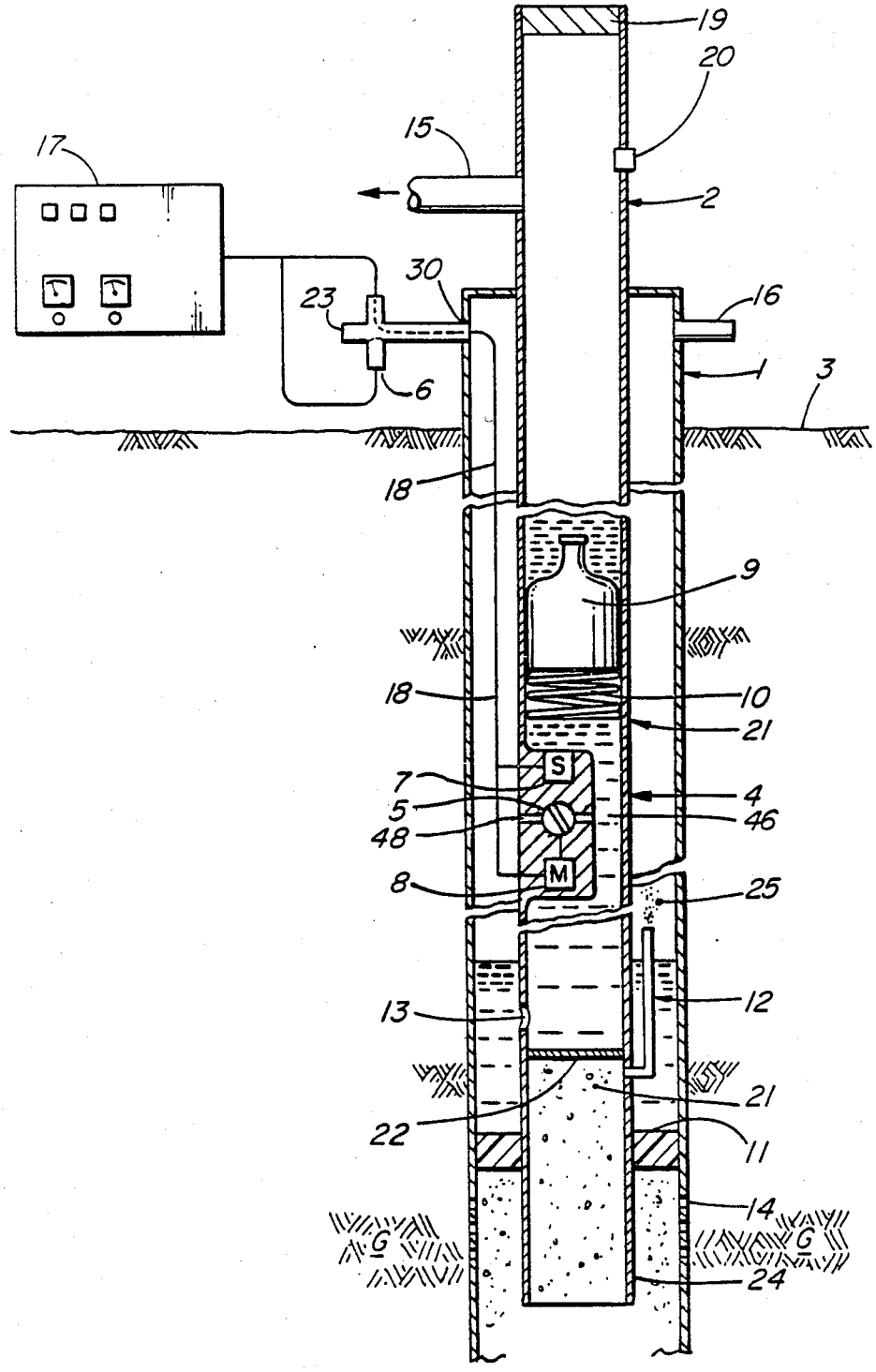
FIG. 1 is a diagrammatic view of one embodiment of the overall system of the invention having an electrically operated valve actuator.

FIG. 1 shows a diagrammatic view of a system including an embodiment of the invention installed in a gas well. A casing 1 is cemented to the surrounding formation in the conventional way. Preferably the casing is at least 4.0 inches in inside diameter, to permit the apparatus of the invention to fit within it, but smaller sizes could be used if appropriate minaturization is employed. In the gas-bearing strata G, the casing 1 contains perforations 14 formed in the conventional manner, to admit the gas from the surrounding formation. The casing 1 is capped at its upper end above ground level 3. A production or sales line 16 is attached in the neighborhood of the cap as is also another port 30, shown here with a test line 23 attached to it.

A tubing string 2, for example of 1.5 inch inside diameter, is located in the casing and extends downward therethrough, terminating in a sealing packer or partition 22 (discussed herein as a first sealing means). Below the assembly 22, a tailpipe 24 extends downwardly to an open lower end. Annulus 25 between the casing 1 and the tailpipe 24 is sealed above the level of perforations 14 by a conventional packer 11 (which forms a second sealing means).

The sealing packer 22 forms part of a crossover sub-assembly generally indicated at 21. A pipe 12 also forms part of the crossover sub-assembly and joins the tailpipe 24 to the annulus 25 between the casing and the tubing string. Side pipe 12 provides a flow channel for the gas which enters the tailpipe 24 from the casing, which gas has escaped from the formation G through perforations 14. The gas flows through side pipe 12 at relatively high velocity and hence carries with it entrained droplets of liquid. Upon entering the annulus 25, which has a much larger cross-sectional area than the side pipe, the gas decreases its velocity. This results in the liquid separating from the gas and accumulating in the annular passage above the packer 11, the gas rising upwards to sales line 16. In this way accumulated water and other liquids are isolated from the casing adjacent perforations 14, thus preventing the build-up of back pressure which would reduce flow from the formation.

A transverse port 13 above the level of partition 22 permits water to enter the tubing string from the annulus at a point above the partition 22. Since outlet pipe 15 adjacent the top of the tubing string is open to atmospheric pressure, the gas pressure in the annulus is higher than that in the tubing, and causes the level of the liquid in the tubing string to rise above that in the annulus. A plunger (which could be one similar to the plunger disclosed in Canadian Pat. No. 1,133,825) 9 is provided in the tubing string, and normally rests on shock absorbing string 10 on top of a mandrel 4 in the tubing string 2.

Figure 3:
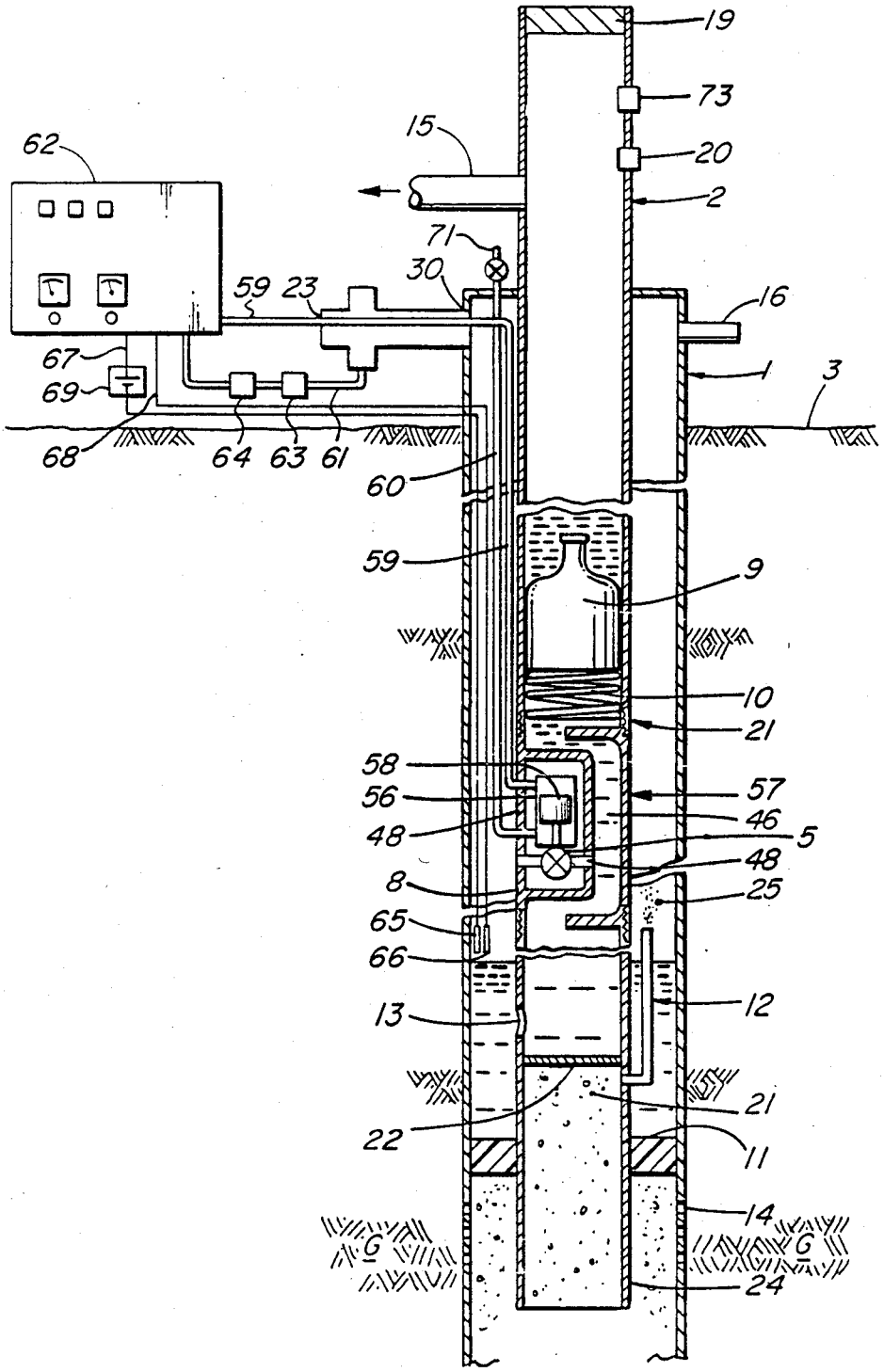
FIG. 3 is a diagrammatic view of another embodiment of the overall system of the invention, having a gas operated valve actuator.

The mandrel 4 is located in the tubing string in the region through which the water rises. The mandrel 4, which will be described in more detail hereinafter, is shown in schematic form in FIG. 1 located well above the side pipe 12. It has a passage 46 through it, which forms a continuation of the tubing string 2. It contains an electrically actuated valve 5 which is opened and closed by an electric motor 8 at a predetermined differential between the gas pressure in the casing and the hydrostatic pressure of the liquid in the tubing string at the mandrel. The valve normally closes a passage 48 from the tubing string to the annulus. Pressure sensor 7, also located in the mandrel 4, provides a reading of the hydrostatic pressure caused by the weight of water or other liquid in the tubing above the mandrel 4. A second pressure sensor 6 is located near the top of the casing 1 and senses gas pressure therein, i.e. in the annulus 25. In the embodiment shown, this sensor is located for convenience in test line 23 attached to port 30. An electrical cable 18 connects sensor 7 and motor 8 to controller 17 to which the output of sensor 6 is also applied. The controller 17, as well as controller 62 in FIG. 3, are known in the art and are commercially available devices, for example, from AFECO, Inc., Houston, Tex., and from Logic Controls, Dayton, Ohio. A controller designated AFECO-TRON Electronic Intermitter is a suitable unit.

When the differential between the pressures measured by sensor 6 and sensor 7 reaches a predetermined level, the controller 17 applies power to motor 8 to open valve 5. Gas under pressure in the annulus 25 then enters the tubing string 5 through the passage 48, and pushes the plunger 9 and water above it to the top of the string, where the water is discharged to atmosphere through outlet pipe 15. A suitable stop or lubricator 19 is provided at the top of the string to receive the plunger when it rises to the top of the tubing. A catcher 20 may be positioned near the top of the tubing string 2 to selectively retain the plunger 9 and permit its removal. When the slug of water has been discharged, gas pressure in the tubing drops the plunger 9 falls back down the tubing string until it rests on the mandrel 4 on top of shock spring 10, which prevents damage to mandrel 4 when the plunger falls back down the tubing string. The plunger is necessary in order that the gas pushes a slug of water before it, rather than passes through the water. It is also useful, in cases where oil is the liquid being removed from the well, to clean off the wax which tends to accumulate on the interior of the tubing.

In addition to the very desirable feature of the present invention by which it can operate reliably at relatively low gas pressures, the system also has considerable flexibility since the preset value of the differential pressure at which valve 5 opens may be adjusted at the controller 17 without need to interrupt operation. This can be done from the wellhead. Alternatively, sensors 6 and 7 can be eliminated, and replaced with a timer at the wellhead, which opens the valve for a predetermined time, at predetermined intervals.

Figure 2:
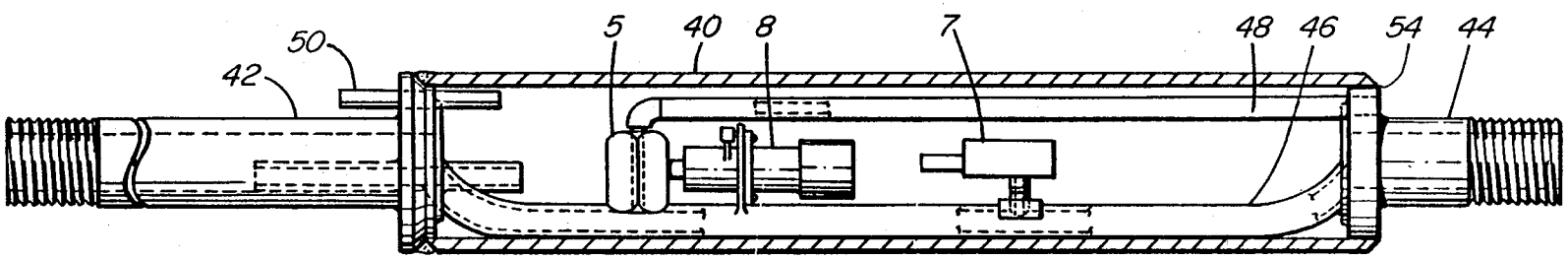
FIG. 2 is a side view of a tubing length or mandrel useable in the embodiment of FIG. 1, such mandrel being shown partly in section.

Details of the mandrel or tubing length 4 used in the embodiment of FIG. 1 are shown in FIG. 2. It is seen that, for durability, the operating elements including valve 5, motor 8 and sensor 7 are enclosed within an enclosure comprising tube 40, shown in section in FIG. 2, connected at the ends thereof to seating nipple 42 and connector 44. Tube 46 within tube 40 passes fluid through the mandrel. The tube 40 as shown in FIG. 2 is connected to nipple 42 and connector 44 by welding but other means may be used so long as the mandrel is capable of withstanding the axial stresses to be placed on it. Connector 44 and nipple 42 join the tubing string, so that the mandrel functions as a tubing length and replaces a portion of the tubing string and tube 46 of the mandrel provides a continuation of flow through the tubing string.

Tube 48 runs from the annular passage formed by the casing and the tubing to join pipe 46. As shown here, tube 48 runs axially, so that it can pass out of the end of tube 40, rather than through the side. This is preferred for durability and ease of assembly, but it is obvious that tube 48 can pass through the side of tube 40 if desired. Indeed this tube is shown as passing through the side of the mandrel in the schematic diagram of FIG. 1. Tube 48 is blocked by normally closed valve 5. When the valve is opened, gas is injected through tube 48 to pipe 46, where it lifts the water above it in pipe 46.

The water pipe 46 which is displaced laterally from the central axis of the tubing string in order to provide room within the very limited space of the mandrel enclosure for valve 5, motor 8, sensor 7 and tube 48 leading to valve 5. Pipe 46 should have as large a diameter as possible in order to avoid blockage from materials such as sand, in the pipe and the valve. An inside diameter of at least $\frac{3}{4}''$ to $1''$ is preferred. Suitably valve 5 is an ordinary ball valve but other types of valve can be used if desired.

Care should be exercised in selecting an actuator for the valve. Most solenoid valves are not preferred, as they are not sufficiently durable for many wells. One solution has been found in the use of a miniature 12 volt d.c. motor and gear box supplied by TRW Inc. In cases where a pneumatic or hydraulic line is available in the well, a pneumatic or hydraulic valve can be used instead of an electric one.

The cable containing the electrical wiring (not shown) connected to motor 8 and sensor 7 is brought out of the mandrel through tubing 50. Tube 50 may be replaced with a suitable sealing device which permits an electrical connection. The electrical wiring can suitably be potted, i.e., encased in a suitable plastic to reduce the likelihood of short circuits from moisture contamination, and to prevent contamination from entering the mandrel.

In the embodiment described, the valve is opened when the differential between the pressures measured by sensors 6 and 7 is reduced to a desired value. As liquid rises in the tubing, the hydrostatic pressure in the tubing increases. The sensor 7 can be located at any convenient point along the liquid column, as the pressure at any point in the column of liquid is, of course, in fixed relation to the pressure at any other point. For convenience the sensor is usually located close to the valve, and forms part of the same mandrel 4 as the valve.

Ideally the valve 5 should be opened when the hydrostatic pressure has reached a level that is less than the casing (annulus) pressure by an amount which allows for efficient lifting of the fluid to the surface. The value of the differential pressure at which the valve is opened will of course, depend on where the sensor 7 is located. Suitable values for any individual installation will be obvious to one skilled in the art.

Instead of using sensors which register the actual pressures being measured, it is of course possible to use pressure switches which change state at particular pressures, and so signal the controller when those pressures are reached. This is not preferred, however, as it lessens the flexibility of control.

While only one mandrel 4 is shown in the disclosed embodiment, it is of course possible to have several mandrels at intervals in the tubing string, to be operated at different differential pressures. This permits a gas lift in stages, which will be useful in wells where there is low gas pressure and large amounts of liquid present.

Figure 4:
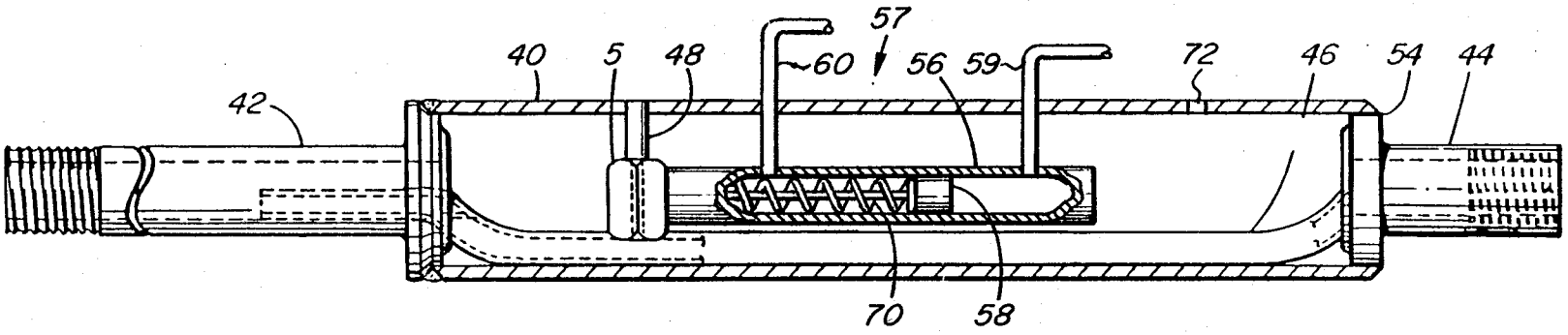
FIG. 4 is a side view of a tubing length or mandrel useable in the embodiment of FIG. 3.

In FIGS. 3 and 4 an embodiment of the invention is shown in which the valve 5 is operated by gas pressure rather than by an electric motor as in the embodiment of FIG. 1. In FIGS. 3 and 4, like parts to the embodiment of FIGS. 1 and 2 are identified by the same numbers as in that embodiment. A tubing length or mandrel 57, which corresponds to mandrel 4, is provided. A cylinder 56 is located in the mandrel 57, cylinder 56 having a moveable piston 58 connected to valve 5 in such a way that movements of the piston open and close the valve. A gas line 59 supplies gas under pressure to force the piston to open the valve 5. The other end of cylinder 56 as shown in FIG. 3 is vented to atmosphere by gas-conducting line 60.

Gas to operate valve 5 is suitably taken from test line 23 via line 61 to controller 62. A drip pot 63 is connected to line 61 to remove moisture and a regulator 64 stabilizes the gas pressure to provide gas at even pressure to the controller. This pressure may be, for example, 60 p.s.i. Controller 62 may operate on a timing cycle supplying gas at regular intervals, for example every 4 hours, by way of line 59 to cylinder 56 to actuate valve 5. The controller supplies the gas under pressure for a given interval, for example 2 minutes, after which time the pressure is released and valve 5 reverts to the normal closed condition under the action of a spring (not shown in FIG. 3). The period and frequency of opening would be adjusted by experience with the particular well to remove a suitable amount of water or other liquid.

Alternatively, the controller may operate to open the valve whenever the water reaches a given level in the well annulus. The level can be determined if desired by a hydrostatic pressure sensor as shown at 7 in the embodiment of FIGS. 1 and 2. An alternative sensor is shown in FIG. 3. In FIG. 3 the numerals 65 and 66 indicate a pair of electrodes which are located at the water level which has been predecided as being the level at which it is desired to operate the water removal. Although the electrodes are shown as being positioned in the annulus between the tubing string and the casing they cah be located in the tubing string if care is taken so that they do not impede the rising of plunger 9.

Electrodes 65 and 66 are connected to controller 62 by electrical conductors 67 and 68 respectively. A voltage supply is also provided to provide a voltage difference between the electrodes. In the schematic drawing of FIG. 3, the voltage supply is shown as a battery 69. When the water rises so as to immerse electrodes 65 and 66 an electrical circuit is completed through the water which causes the controller to actuate valve 5 to the open position. There are of course many salts dissolved in ground water in wells, by reason of the water having leached such salt out of the ground, so that the water forms a good conductor to complete the circuit.

Electrodes 65 and 66 may be suitably two stainless steel probes 1 inch in length located parallel to one another at a spacing of one-half inch, the voltage supply being a 6-volt cell. This is merely an example of suitable parameters for the probes. Those skilled in the art will recognize that other configurations may be used.

As an alternative to controlling the operation by water level hydrostatic pressure, the controller can be operated by a timer, so that the valve 5 is automatically closed after a given time, such as two minutes after opening. Alternatively, closing may be accomplished by installing a switch 73 near the lubricator 19 and catcher 20. This switch 69 is connected to the controller by electric conductors (not shown) and is operated by plunger 9. Each time the plunger rises to the top of the string with a slug of water switch 69 closes which causes the controller to close valve 5, by cutting off the supply of gas and venting the line 59 so that the valve closes under the action of the spring.

The mandrel 57 shown in FIG. 4 is very similar to the mandrel 4 of FIG. 2 except that it employs gas pressure to actuate the valve rather than an electrical motor. Gas entering cylinder 56 from the controller by way of line 59 forces piston 58 toward the left as shown in FIG. 4 to open valve 5. At the same time coil spring 70, located on the opposite side of the piston, is compressed. When the gas pressure is released spring 70 causes the piston to return to its former position and thus to close valve 5.

A second gas-conducting line 60 is connected to the cylinder as shown in FIG. 4. This line is vented to atmosphere, to ensure that the pressure of the gas passing through line 59 is greater than the pressure on the other side of the piston. If desired, the spring can be omitted, and each lines 59 and 60 can be selectively connected to atmosphere or a high pressure gas source. Then when it is desired to close the valve, line 59 is vented to atmosphere and line 60 is connected to the high pressure gas source, thus causing the piston to move in the other direction and close valve 5.

Pressure equalizing hole 72 is provided to equalize the internal and external pressures on mandrel 57.

It may be advisable to open valve 5 at least once a day whether or not the water level is high, in order to flush out sand which might block passages in the well. Thus even when operating under control of a sensor, it may also be desirable to have a timer to effect this daily actuation of the system.

It is also possible to control the valve by sensing gas production. When the gas production falls below a certain level, then the controller will operate to open the valve for a predetermined time, to lift out the accumulated liquid. In this mode, the controller is connected to a flowmeter (not shown) in line 16, to measure production.

The invention can also be used in situations where there is little or no gas in a well, but it is desired to raise liquid from the well. In such circumstances, gas can be pumped into the casing from the surface to get the required gas pressure, after which the invention can be carried out as described herein.

While only certain embodiments of the invention have been described, it will be recognized that various modifications may be made by those skilled in the art without departing from the spirit and scope of the invention which is defined not in terms of the preceding embodiments but rather solely by the appended claims.

We claim:

1. A gas lift apparatus for removing accumulated liquid from a gas or oil well having a well casing the casing containing gas under pressure from said well, comprising:

a tubing string within said casing vented to atmosphere above ground and sealed above a tail section thereof in a producing formation, said tail section having venting means venting it into the space between the tubing string and the casing above the tail section, and an aperture in said tubing string just above the sealed tail section for conducting accumulated liquid into said tubing string;

a mandrel in said tubing string, positioned well above said venting means, housing a valve for admitting gas from inside said well casing into said tubing string, said valve being opened and closed by means of an electric motor in said mandrel;

control means for controlling said valve from above ground in a predetermined manner, to admit and cease to admit said gas, in response to liquid level in said well casing; and plunger means above said mandrel for evacuating accumulated liquid to above ground as the plunger is propelled by admitted gas.

2. A gas lift apparatus for removing accumulated liquid from a gas or oil well having a well casing, the casing containing gas under pressure from said well, comprising:

a tubing string within said casing vented to atmosphere above ground and sealed above a tail section thereof in a producing formation, said tail section having venting means venting it into the space between the tubing string and the casing above the tail section, and an aperture in said tubing string just above the sealed tail section for conducting accumulated liquid into said tubing string;

a mandrel in said tubing string, positioned well above said venting means, housing a valve for admitting gas from inside said well casing into said tubing string, said valve being opened and closed by means of a fluid-actuated piston and cylinder assembly in said mandrel;

control means for controlling said valve from above ground in a predetermined manner, to admit and cease to admit said gas, in response to liquid level in said well casing; and plunger means above said mandrel for evacuating accumulated liquid to above ground as the plunger is propelled by admitted gas.

3. Apparatus as claimed in claim 1 or 2, wherein said control means opens said valve at a predetermined pressure difference, corresponding to liquid level difference, between the hydrostatic pressure at a preset location in said tubing string and the gas pressure in the well casing.

4. Apparatus as claimed in claim 1 or 2 further comprising a discharge pipe for evacuating said accumulated liquid connected to the upper portion of said tubing string and being open to atmospheric pressure.

5. Apparatus as claimed in claim 1 or 2 further comprising a pair of spaced electrodes located in said well at a level where water is likely to collect, said means to actuate said valve being responsive to the presence of water between said electrodes to open said valve.

6. Apparatus as claimed in claim 5 in which the electrodes are located in the annulus between the well casing and the tubing string.

7. Apparatus as claimed in claim 2, wherein said piston is operated by gas pressure delivered from a controller accessible from the wellhead to actuate said valve.

8. Apparatus as claimed in claim 7 wherein said means to actuate said valve further comprises a source of suitably pressurized gas, means to conduct gas from said source to said cylinder to operate said piston and a controller at the ground surface to control the flow of gas to said cylinder so as to open and close said valve.

9. Apparatus as claimed in claim 8 wherein said source of gas is pressurized gas within said well casing, and said means to conduct gas from said source to said cylinder comprises a first gas line connecting said well casing to said controller and a second gas line connecting said controller to said cylinder.

10. Apparatus as claimed in claim 9 wherein said second gas line is connected to said cylinder so that, upon actuation by said controller, gas pressure applies sufficient force to one side of said piston to open said valve, said apparatus further comprising means to apply force to the other side of said piston to close said valve when said gas pressure is removed.

11. Apparatus as claimed in claim 10 wherein said means to apply force to close said valve is a return spring.

12. Apparatus as claimed in claim 10 wherein a third gas line vented to atmosphere is connected to said cylinder on the other side of said piston.

* * * * *